US009277322B2

(12) United States Patent
Bech et al.

(10) Patent No.: US 9,277,322 B2
(45) Date of Patent: Mar. 1, 2016

(54) SYSTEM FOR OPTIMIZING THE PERCEIVED SOUND QUALITY IN VIRTUAL SOUND ZONES

(71) Applicant: Bang & Olufsen A/S, Struer (DK)

(72) Inventors: Søren Bech, Viborg (DK); Jonathan Francombe, Somerset (DK); Martin Dewhirst, Buckinghamshire (GB); Russell Mason, Surrey (GB)

(73) Assignee: BANG & OLUFSEN A/S, Struer (DK)

( * ) Notice: Subject to any disclaimer, the term of this patent is extended or adjusted under 35 U.S.C. 154(b) by 244 days.

(21) Appl. No.: 13/781,893

(22) Filed: Mar. 1, 2013

(65) Prior Publication Data

US 2013/0230175 A1 Sep. 5, 2013

(30) Foreign Application Priority Data

Mar. 2, 2012 (DK) ..... 2012 00167

(51) Int. Cl.
*H04R 5/04* (2006.01)
*H04S 7/00* (2006.01)

(52) U.S. Cl.
CPC .. *H04R 5/04* (2013.01); *H04S 7/30* (2013.01); *H04R 2499/13* (2013.01); *H04S 2400/11* (2013.01)

(58) Field of Classification Search
CPC ..... H04R 5/40; H04R 2499/13; H04S 7/30; H04S 2400/11
USPC ..... 381/17, 58, 59, 71.11, 86, 103; 704/502
See application file for complete search history.

(56) References Cited

U.S. PATENT DOCUMENTS 7,813,933 B2 * 10/2010 Martin ..... 704/502
8,111,836 B1 2/2012 Graber
2003/0002680 A1 * 1/2003 Akiyama ..... H04H 20/28 380/278
2004/0223620 A1 * 11/2004 Horbach ..... H04R 29/002 381/59
2006/0034467 A1 * 2/2006 Sleboda ..... H04R 5/02 381/86
2006/0262935 A1 * 11/2006 Goose ..... H04S 3/002 381/17
2007/0189549 A1 * 8/2007 Scheel ..... H04R 27/00 381/86
2008/0101620 A1 * 5/2008 Horbach ..... H04R 29/002 381/59
2010/0076793 A1 * 3/2010 Goldstein et al. ..... 705/4
2010/0124337 A1 * 5/2010 Wertz ..... G10K 11/1782 381/71.11
2010/0135503 A1 6/2010 Shin et al.
2010/0284544 A1 * 11/2010 Kim et al. ..... 381/56
2010/0290635 A1 * 11/2010 Shridhar ..... G10K 11/1786 381/71.1

(Continued)

FOREIGN PATENT DOCUMENTS

JP 05-344584 12/1993

OTHER PUBLICATIONS

Danish Search Report for DK PA 2012 00167 dated Sep. 18, 2012.

(Continued)

*Primary Examiner* — William Deane, Jr.
(74) *Attorney, Agent, or Firm* — Nicholas B. Trenkle; Stites & Harbison PLLC

(57) ABSTRACT

The invention discloses a system applied to optimize the perceived sound quality in virtual sound zones. The system includes a method to establish a threshold of acceptability for an interfering audio programme on a target audio programme. The method includes physical parameters like target programme and interferer programme which combined with the scenarios: information gathering, entertainment and reading and/or working, constitutes modes of operations that may be processed and controlled by a system controller.

13 Claims, 1 Drawing Sheet

(56) References Cited

U.S. PATENT DOCUMENTS

| | | | | |
|---|---|---|---|---|
| 2010/0329488 | A1* | 12/2010 | Holub | H04R 27/00 381/301 |
| 2012/0020486 | A1* | 1/2012 | Fried | H03G 3/32 381/58 |
| 2012/0140945 | A1 | 6/2012 | Harris | |
| 2012/0327304 | A1* | 12/2012 | Kashi | H04L 12/282 348/707 |
| 2014/0014525 | A1* | 1/2014 | Smith | C25B 15/00 205/342 |
| 2015/0100991 | A1* | 4/2015 | Risberg | H04L 67/104 725/80 |

OTHER PUBLICATIONS

Terence Betlehem and Paul D. Teal: "A constrained optimization approach for multi-zone surround sound", International Conference on Acoustics, Speech and Signal Processing (ICASSP), 2011, IEEE, May 22, 2011, pp. 437-440.

Wu Y. J. and Abhayapala T. D.: "Multizone 2D soundfield reproduction via spatial band stop filters", Workshop on Applications of Signal Processing to Audio and Acoustics, WASPAA '09, IEEE, Nov. 18, 2009, Piscataway, NJ, USA, pp. 309-312.

Yan Jennifer Wu and Thushara D. Abhayapala: "Spatial Multizone Soundfield Reproduction: Theory and Design", IEEE Transactions on Audio, Speech and Language Processing, Aug. 1, 2011, IEEE Service Center, New York, NY, USA, vol. 19, No. 6, pp. 1711-1720.

* cited by examiner

SYSTEM FOR OPTIMIZING THE PERCEIVED SOUND QUALITY IN VIRTUAL SOUND ZONES

The invention relates to sound reproduction systems and more specifically to the reproduction of sound in two sound zones within a listening domain.

BACKGROUND OF THE INVENTION

In today's media-driven society, there are ever more ways for users to access audio, with a plethora of products producing sound in the home, car or almost any other environment. Potential audio programmes include a large variety of music, speech, sound effects and combinations of the three. It is also increasingly common for products producing audio to be portable. This wide range of increasingly portable products which produce audio coupled with the ubiquity of audio in almost all facets of society naturally leads to an increase in situations in which there is some degree of audio-on-audio interference.

Examples of such situations might include audio produced by a laptop computer in a room with a television; a mobile phone conversation whilst a car radio is on, or in the presence of piped music in a shopping centre; or competing workstations in an office environment. It is therefore of interest in a number of areas, within the audio industry and beyond, to evaluate the perceived effect of audio interference upon a target audio programme.

A system for reproduction of different sound signals in a plurality of independent sound zones is described in GB 2472092 A. However, contrary to the method and system according to the present invention, the system described in this document uses loudspeakers placed in or adjacent each different zones. Furthermore the system divides the total frequency band into a high frequency band and a low frequency band and directs the high frequency components into the appropriate zone by using a directional loudspeaker array, whereas the amplitude, phase and delay of the low frequency components are adjusted according to the specific sound zone.

SUMMARY OF THE INVENTION

On the above background, it is an object of the invention to implement methods in audio renderings systems that are enabled to eliminate the undesired interference among sound zones identified in a listing domain. According to the invention this can be achieved by a traditional setup of loudspeakers, i.e. the present invention does not require that the loudspeakers be placed in or adjacent to each different sound zone.

The invention includes a control system configured to adjust primary parameters, like amplification, filtering, and delay of the individual sound rendering systems present in the listening area and alternatively or supplemental to preprocess the audio signal programme and thereby to obtain a predefined "threshold of acceptability" for an interfering audio programme.

The invention is based on research results documented in the following document, which is hereby incorporated by reference:

Audio Engineering Society—Convention Paper Presented at the 132$^{nd}$ Convention 2012 Apr. 26-29 Budapest, Hungary "Determining the Threshold of Acceptability for an Interfering Audio Programme", In the above document there is described an experiment that was performed in order to establish the threshold of acceptability for an interfering audio programme on a target audio programme, varying the following physical parameters: target programme, interferer programme, interferer location, interferer spectrum, and road noise level. Factors were varied in three levels in a Box-Behnken fractional factorial design. The experiment was performed in three scenarios: information gathering, entertainment, and reading/working. Nine listeners performed a method of adjustment task to determine the threshold values. Produced thresholds were similar in the information and entertainment scenarios, however there were significant differences between subjects, and factor levels also had a significant effect: interferer programme was the most important factor across the three scenarios, whilst interferer location was the least important.

More specifically the invention addresses the problem a user has when listening to a target programme in one sound zone and is annoyed by an interfering sound coming from another source, appearing randomly or continuously, this sound perceived as noise by the user.

The methods applied for creating and controlling virtual sound zones are disclosed in a patent from the applicant U.S. Pat. No. 7,813,933: "Method and Apparatus for Multichannel Upmixing and Downmixing" which is hereby incorporated by reference.

According to a first aspect, the present invention relates to a method for the reproduction of multi-channel sound signals in virtual sound zones, where the method comprises the following steps:

(i) providing one or more sound rendering systems comprising one or more sound emitting transducers, amplifier means, filtering means and delay means, which means are controllable by external control signals, and microphone means;

(ii) providing system controller means configured to provide said control signals for said one or more sound rendering systems;

(iii) providing means for defining one or more sound zones that are perceived as different sound areas by human listeners;

(iv) based on said definitions of sound zones, controlling said amplifier means, filter means and delay means such that said sound emitting transducers produce said different sound zones;

where the gain of each respective amplifier means is chosen such that the resultant sound pressure level in said first sound zone is at least equal to the sound pressure level in the first zone produced by the total acoustic output from the second sound zone plus an acceptance factor that is generally a function of at least a mode of operation of a listener in the first sound zone and the interferer programme, interferer location and interferer spectrum.

According to a specific embodiment of the invention, the acceptance factor is furthermore a function road noise, which yields the inventive method particularly applicable for sound reproduction in the cabin of a vehicle.

According to a second aspect, the invention relates to a system for the reproduction of multichannel sound signals in virtual sound zones, wherein the system comprises (a) A system controller enabled to receiving multichannel sound signals;

(b) where the system controller is enabled to provide sound signals and control data to one or more sound rendering systems, such as a number of loudspeakers as for instance in a standard 2.0 or 2.1 stereophonic or 5.0 or 5.1 surround sound system;

(c) where at least one of the one or more sound rendering systems includes one or more active sound transducers, each including control of amplifier—, filtering and delay means and microphone means;

(d) where the system controller is enabled to configure and control a first sound zone and a second sound zone, which two sound zones are being perceived as two different sound areas by listeners;

(e) where the system controller configures each of the individual sound rendering systems so that a specific sound isolation is obtained between the first- and the second sound zone.

A system where the sound isolation between the first- and the second sound zone is characterized as a level of interference from an audio programme provided in the second zone to an active listener in the first zone.

The term "threshold of acceptability" is important to note, and it is point where the listener is happy with the situation, or the interferer is 'no longer annoying'. In an informal listening test, this task seemed much more natural than trying to quantify the extent of the annoyance experienced. In addition the task being performed by the user has a pronounced effect on the acceptability threshold.

It has been found that a number of variable parameters like target programme material, interferer programme material, spectrum of program and interferer material and the location of the sound zones, has an effect on the experience of listening to the target audio in the presence of the interfering audio.

Thus, in the method and system of the present invention, the sound isolation parameters are based on the findings done in the above mentioned study, i.e. the parameters for "the threshold of acceptability", which basically is the dB level the "interfering/noise signal" must be suppressed, with reference to the target programme.

DETAILED DESCRIPTION OF THE INVENTION

Figure 1:
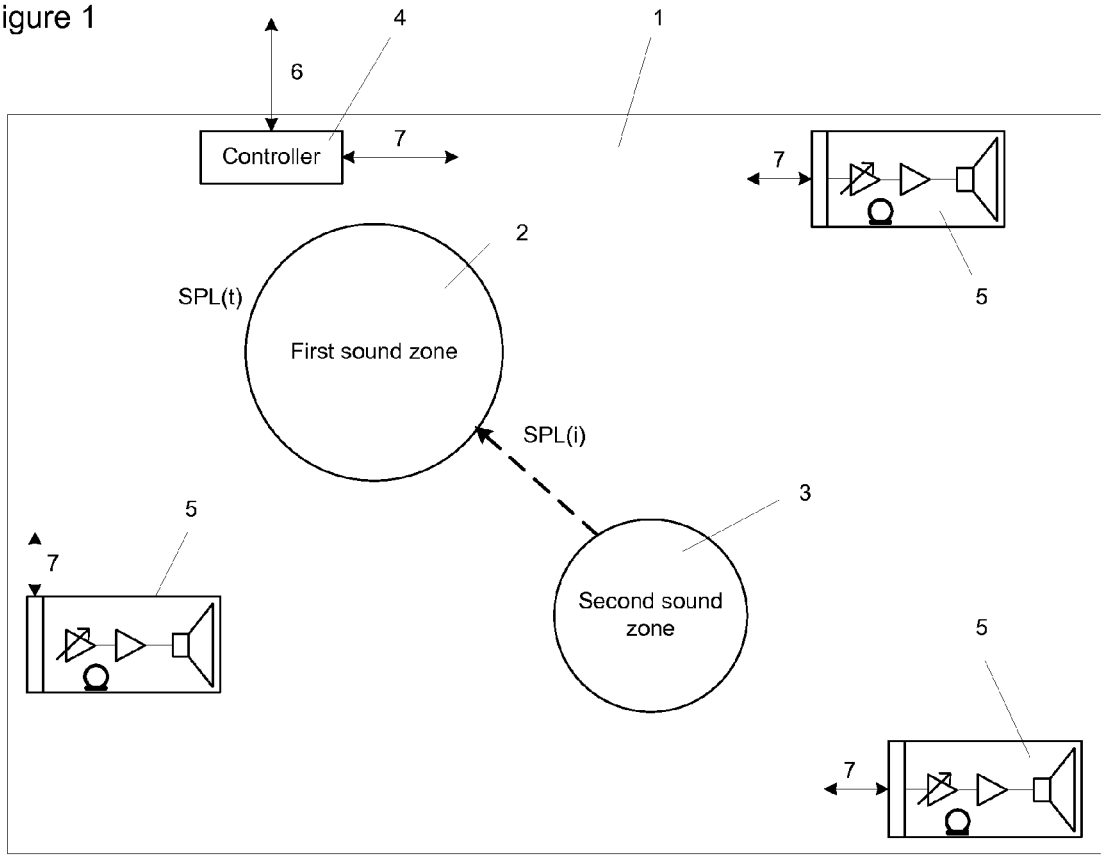
FIG. 1 displays a domain in which two sound zones are identified.

As audio-on-audio interference is a relatively novel research area, there is little in the way of research looking into the acceptable level of interfering audio. The current invention applies the actual findings into methods and practical operational functionalities by introducing modes of operations and factors having different impact in the alternative modes of operation. The modes of operation include: a range of scenarios, programme material and other parameters that may affect the situation, and combines:

- The target-to-interferer ratio required for an audio-on-audio interference situation to be acceptable.
- The effect of the task being performed by a listener on this acceptable level.
- The magnitude of the effects of various physical parameters; and
- The individual differences between participants.

The modes of operation include use scenarios, where the scenarios reflect realistic tasks that people may carry out in the presence of an interfering audio programme:

- Information Gathering: "Imagine that you are at home or in the car, listening as if you were required to understand, act on and/or pass on the information presented".
- Entertainment: "Imagine that you are relaxing (at home or in the car) by listening to music or a football match".
- Reading/Working: "Please read the provided newspaper article. Imagine you are reading or working at home, the office or in the car".

Thus, an aspect of the invention is a system where the listener in the first zone is active in alternative modes of operation by listening to a target programme:

- Information gathering and listening to: male news speech and/or female news speech and/or sports commentary;
- Entertainment by listening to: vocal pop music and/or sports commentary and/or instrumental classical music;
- Reading or working while listening to audio the target being silence;

and with each mode having individual values of sound isolation to obtain specific threshold of acceptability for an interfering audio programme provided in the second zone.

The modes of operation may include user subjects, thus different individual may react different on an interfering sound, this reaction being dependent on gender, age, gender, experience, education and alike.

The modes of operation include influencing factors at the target programme:

- Target programme (information), in which the user listens, (in order to understand) to:
  - Male News Speech
  - Sports Commentary
  - Female News Speech
- Target programme (entertainment), in which the user listens (as entertainment/relaxation) to:
  - Vocal Pop Music
  - Sports Commentary
  - Instrumental Classical Music
- Thus, in a further aspect of the invention a system where the interfering audio programme from the second zone is an active sound source provided from one or more of the sound rendering system, and where the interferer programme is active in alternative modes:
  - male speech and/or,
  - instrumental classical music and/or,
  - vocal pop music;

and with each mode having individual values of sound isolation to obtain specific threshold of acceptability for the interfering audio programme perceived in the first zone.

The mode of operation include influencing factors related to the interfering programme and is the same in all scenarios, as interference could potentially come from any source regardless of the target task:

- Interferer programme
  - Male Speech
  - Instrumental Classical Music
  - Vocal Pop Music
- Interferer location
  - 0-degree interferer
  - 90-degree interferer
  - Diffuse interferer
- Interferer spectrum (attenuation of low- or high- frequencies in the interfering programme),
  - Low Pass Filtered (200 Hz, 9 dB/oct)
  - Flat
  - High Pass Filtered (1 kHz, 16 dB/oct)
- Road noise (in the automotive environment).
  - No Noise
  - 30 mph Road Noise (60 dBA)
  - 70 mph Road Noise (70 dBA)

The data identified as the Information Scenario main effect are listed below.

The effect of all of the factors is fairly intuitive: speech-on-speech interference has a lower threshold of acceptability than music-on-speech; low-pass filtering increases the threshold (possibly because of a decrease in sibilance or transients); adding road noise increases acceptability (presumably as the interferer becomes more masked); and sports commentary targets produce a slightly higher threshold (possibly due to the consistent crowd noise).The target programme was included as independent variable (three levels: male news speech, sports commentary, female news speech) .The effect of location was less pronounced.

| Factor | Level | Mean | Standard Error |
|---|---|---|---|
| Interferer Programme | MS | −19.3611 | 1.8712 |
| | C | −12.0623 | 0.9528 |
| | P | −15.0671 | 1.8689 |
| Interferer Spectrum | LPF | −10.3241 | 1.8057 |
| | Flat | −14.4108 | 0.9626 |
| | HPF | −15.2974 | 2.0553 |
| Road Noise | None | −14.9790 | 1.0368 |
| | 30 mph | −12.6817 | 1.7738 |
| | 70 mph | −10.8090 | 1.4996 |
| Target Programme | MNS | −15.5822 | 2.1471 |
| | SC | −13.1299 | 0.9164 |
| | FNS | −14.8426 | 2.0890 |

For the influence of factors in Information Scenario, the difference in acceptability threshold between the conditions producing the highest and lowest thresholds for each factor, detailing the factor levels producing the extreme threshold values, are listed below.

The 'Difference' indicates the difference in dB between the levels producing the highest and lowest thresholds.

| Factor | Difference | High Threshold | Low Threshold |
|---|---|---|---|
| Interferer Programme | 7.30 dB | Instrumental Classical Music | Male Speech |
| Interferer Spectrum | 4.97 dB | LPF | HPF |
| Road Noise | 4.17 dB | 70 mph | None |
| Target Programme | 2.45 dB | Sports Commentary | Male News Speech |
| Interferer Location | 1.60 dB | Diffuse | 0 Degrees |

The data identified as the Entertainment Scenario main effect are listed below, and illustrates the error bar plots for the most influential factors.

| Factor | Level | Mean | Standard Error |
|---|---|---|---|
| Interferer Programme | MS | −30.3669 | 1.5499 |
| | C | −22.3737 | 0.5957 |
| | P | −26.2048 | 1.3364 |
| Target Programme | Pop | −20.8483 | 0.9781 |
| | SC | −24.6744 | 0.7253 |
| | Class | −27.0960 | 1.3145 |
| Road Noise | None | −25.8760 | 0.6940 |
| | 30 mph | −22.7905 | 1.3085 |
| | 70 mph | −20.6817 | 1.2183 |
| Interferer Spectrum | LPF | −23.3287 | 1.4318 |
| | Flat | −23.9586 | 0.6656 |
| | HPF | −27.2998 | 1.4396 |

For the influence of factors in Entertainment Scenario, the difference in acceptability threshold between the conditions producing the highest and lowest thresholds for each factor, detailing the factor levels producing the extreme threshold values, are listed below.

It can be seen that the interferer programme is again the most influential factor with a difference of 8 dB between the highest and lowest thresholds; the factor levels producing the highest and lowest threshold are the same as in the information task. Target programme has a larger effect in the entertainment task; this could be attributed to the nature of the programme material used in this scenario, with vocal pop music more heavily compressed and therefore masking the interfering programme more consistently. The magnitude of the effect of road noise is similar to that in the information scenario and that of spectrum slightly lower. Again, interferer location had the smallest effect on threshold.

The 'Difference' indicates the difference in dB between the levels producing the highest and lowest thresholds.

| Factor | Difference | High Threshold | Low Threshold |
|---|---|---|---|
| Interferer Programme | 7.99 dB | Instrumental Classical Music | Male Speech |
| Target Programme | 6.25 dB | Vocal Pop Music | Male News Speech |
| Road Noise | 5.19 dB | 70 mph | None |
| Interferer Spectrum | 3.97 dB | LPF | HPF |
| Interferer Location | 2.50 dB | Diffuse | 90 Degrees |

The data identified as the Reading/Working Scenario main effect are listed below, and illustrates the error bar plots for the four influential factors.

The order of importance of the factors is somewhat different to the previous scenarios, and the magnitude of the important effects is much larger. Introducing road noise at 70 mph increases the threshold of acceptability by approximately 19 dB; this can be attributed to the extra masking provided by the road noise when there is no target programme. The magnitude of the effect of interferer programme is similarly inflated to 15 dB, with the same programme items as in the previous scenarios producing the lowest and highest thresholds. The interferer spectrum and location have similar effects to the information and entertainment scenarios.

| Factor | Level | Mean | Standard Error |
|---|---|---|---|
| Road Noise | None | −34.4236 | 2.3754 |
| | 30 mph | −20.9548 | 2.8059 |
| | 70 mph | −15.0486 | 2.3312 |
| Interferer Programme | MS | −38.1111 | 3.0990 |
| | C | −22.8437 | 2.2278 |
| | P | −26.8420 | 3.7501 |
| Interferer Spectrum | LPF | −25.6459 | 3.7555 |
| | Flat | −26.2236 | 2.2823 |
| | HPF | −30.8576 | 3.7444 |
| Interferer Location | Diffuse | −27.8403 | 3.7878 |
| | 90 deg | −26.3035 | 2.2947 |
| | 0 deg | −28.4635 | 3.7409 |

For the influence of factors in Reading/Working Scenario, the difference in acceptability threshold between the conditions producing the highest and lowest thresholds for each factor, detailing the factor levels producing the extreme threshold values, are listed below.

The 'Difference' indicates the difference in dB between the levels producing the highest and lowest thresholds.

| Factor | Difference | High Threshold | Low Threshold |
|---|---|---|---|
| Road Noise | 19.38 dB | 70 mph | None |
| Interferer Programme | 15.27 dB | Instrumental Classical Music | Male Speech |

-continued

| Factor | Difference | High Threshold | Low Threshold |
|---|---|---|---|
| Interferer Spectrum | 5.21 dB | LPF | HPF |
| Interferer Location | 2.16 dB | 90 Degrees | 0 Degrees |

Conclusively the disclosed experimental data for the threshold of acceptability is derived with the 50% and 95% acceptable points for each scenario as displayed below:

| Scenario | Experienced (50%/95%) | Inexperienced (50%/95%) |
|---|---|---|
| Information (HT) | −2.33 dB/−11.67 dB | N/A |
| Information (LT) | −25.17 dB/−42.23 dB | −12.50 dB/−23.62 dB |
| Entertainment | −26.83 dB/−39.17 dB | −17.00 dB/−31.35 dB |
| Reading/Working | −31.17 dB/−57.67 dB | −12.08 dB/−34.87 dB |

These results provide useful information as to the level of audio interference which may be considered acceptable during the performance of certain tasks.

There are pronounced differences between subjects: inexperienced listeners produced median threshold values between 10 dB and 18 dB above those of experienced listeners. Some of these differences were attributed to a different understanding of the task between subjects. At the same time, some of these differences may be attributed to personal differences between listeners (e.g. temperament, mood, prior experience etc.).

The effect of physical parameters is somewhat determined by the task, and is seemingly heavily influenced by the target programme. In the reading/working scenario, there is up to 19 dB difference between thresholds produced at different levels of road noise and for different interferer programmes. The effect of each factor is less pronounced in the information and entertainment scenarios, with the most influential parameters being interferer programme (approximately 8 dB between the means for the highest and lowest threshold groups). In conclusion, it seems that interferer programme has the greatest effect on threshold, followed by road noise level, spectrum and target programme which are more or less important depending on scenario. Interferer location was found to be the least influential parameter in all cases.

FIG. 1 displays a listener domain (1) e.g. a room in a house, in which an audio rendering system is active, the system including a controller (4) having access to media files (6) and controlling and streaming audio data (7) wired or wirelessly to loudspeaker means (5), the means including amplifiers (9), filters (10) and delays (11), and microphones (8). The controller may create virtual sound zones by adjusting the physical means amplifiers, filters and delays in each of the physical loudspeaker means (5).

A user selected and activated target programme as provided in the virtual first sound zone (2) and delivering a certain sound pressure level SPL(t).

An interferer active programme may be another sound source provided in the second sound zone (3) and delivering a certain sound pressure level SPL(i) in the first sound zone (2).

In modes in which the interferer pressure level may be controlled by the system controller (4) the virtual second sound zone is adjusted accordingly to accommodate to the pre-defined threshold of acceptability parameter values:

Thus according to an embodiment of the invention:

The values of the sound isolation related to experienced users are typically:

Information (HT) xx1 to yy1 e.g.: −2.33 dB/−11.67 dB;
Information (LT) xx2 to yy2 e.g.: −25.17 dB/−42.23 dB;
Entertainment xx3 to yy3 e.g.: −26.83 dB/−39.17 dB;
Reading/working xx4 to yy4 e.g.: −31.17 dB/−57.67 dB.

The values of the sound isolation related to inexperienced users are typically:

Information (LT) xx22 to yy22 e.g.: −12.50 dB/−23.62 dB;
Entertainment xx33 to yy33 e.g.: −17.00 dB/−31.35 dB;
Reading/working xx44 to yy44 e.g.: −12.08 dB/−34.87 dB.

Alternatively or supplemental to adjusting the SPL to an acceptable level, it may be possible to change the signal by increasing the level at which the interference is acceptable.

Figure 2:
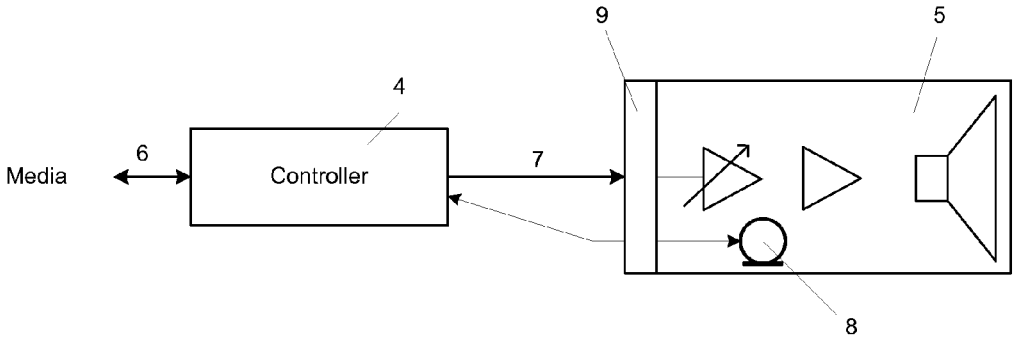
FIG. 2 displays a block diagram of a sound rendering system.

FIG. 2 displays an embodiment of the controller (4) interfacing (7) to the loudspeaker means (5), amplifier (9) and the microphone (8). The controller may be a signal processor, microcomputer or alike as required by the system performance.

In a preferred embodiment of the invention, the variables for modes of operation, scenario and factors and isolation are enumerated in a constraint domain table including all legal combinations of the defined variables; the table to be processed by a constraint solver to find the actual parameters settings for amplifiers, filters, and delays related to the addressed sound zone.

The constraint solver processing enables an arbitrary access mode to information with no order of sequences required.

According to the invention, the constraint solver domain table is organized as relations among variables in the general mathematical notation of 'Disjunctive Form': Variable 1.1 and Variable 1.2 and Variable 1.3 and Variable 1.n Or Variable 2.1 and Variable 2.2 and Variable 2.3 and Variable 2.n Or . . .

Or . . .

Or Variable m.1 and Variable m.2 and Variable m.3 and Variable m.n

An alternatively definition term is the 'Conjunctive Form':

Variable 1.1 or Variable 1.2 or Variable 1.3 or Variable 1.n

And Variable 2.1 or Variable 2.2 or Variable 2.3 or Variable 2.n

And . . .

And . . .

And Variable m.1 or Variable m.2 or Variable m.3 or Variable m.n

With this method of defining the problem/solution domain, it becomes a multi-dimensional state space enabling equal and direct access to any point in the defined set of solutions.

The present invention addresses an area with a wide range of applications and may be applied to any system which aims to mitigate the effects of audio-on-audio interference, for example, noise-cancellation systems or source separation algorithms.

The invention claimed is:

1. A method for reproducing multi-channel sound signals in virtual sound zones in a sound system, the sound system comprising one or more sound rendering systems having two or more sound emitting transducers, amplifier means, filtering means, and delay means, microphone means, and a system controller configured to provide external control signals for said one or more sound rendering systems, the amplifier means, filtering means, and delay means of the one or more sound rendering systems being controllable by the external control signals, the method comprising:

providing respective definitions of two or more different sound zones that are perceptible as different sound areas by human listeners; and based on said definitions of the different sound zones, controlling said amplifier means, filter means, and delay means of the one or more sound rendering systems such that said sound emitting transducers produce said different sound zones, and wherein, to produce the different sound zones, a respective gain of each amplifier means is chosen such that a resultant sound pressure level in a first sound zone of the different sound zones is at least equal to a sound pressure level in the first sound zone produced by a total acoustic output from a second sound zone of the different sound zones plus an acceptance factor that is a function of at least a mode of operation of a listener in the first sound zone and a mode of an interferer audio programme provided from the second sound zone, an interferer location related to the interferer audio programme, and an interferer spectrum related to the interferer audio programme, such that a sound isolation between the first and second sound zones is obtained.

2. A method according to claim 1, wherein said acceptance factor is also a function of road noise.

3. A method according to claim 1, wherein the mode of operation of the listener in the first sound zone is selected from listening to a target audio programme for purposes of information gathering, listening to a target audio programme for purposes of entertainment, and listening to a target audio programme of silence for purposes of reading or working, wherein the target audio programme for purposes of information gathering is one or more of male news speech, female news speech, and sports commentary;

wherein the target audio programme for purposes of entertainment is one or more of vocal pop music, sports commentary, and instrumental classical music; and wherein each mode of operation of the listener in the first sound zone has respective values of sound isolation for obtaining a specific threshold of acceptability for the interferer audio programme provided from the second sound zone.

4. A method according to claim 1, wherein the interferer audio programme provided from the second sound zone is an active sound source provided from the one or more sound rendering systems, and wherein the interferer audio programme is active in at least one mode selected from male speech;

instrumental classical music; and vocal pop music; and wherein each mode for the interferer audio program has respective values of sound isolation for obtaining a specific threshold of acceptability for the interferer audio programme as perceived in the first sound zone.

5. A method according to claim 3, wherein the respective values of sound isolation for the modes of operation of the listener in the first sound zone related to experienced users are:

information gathering in high-threshold conditions: -2 dB to -12 dB;

information gathering in low-threshold conditions: -25 dB to -42 dB;

entertainment: -27 dB to -39 dB;

reading or working: -31 dB to -58 dB.

6. A method according to claim 3, wherein the respective values of sound isolation for the modes of operation of the listener in the first sound zone related to inexperienced users are:

information gathering in low-threshold conditions: -13 dB to -24 dB;

entertainment: -17 dB to -31 dB;

reading or working: -12 dB to -35 dB.

7. A sound system for reproducing multi-channel sound signals in virtual sound zones, the sound system comprising:

one or more sound rendering systems including two or more active sound transducers, amplifier means, filtering means, delay means, and microphone means; and a system controller configured to receive multi-channel sound signals and provide sound signals and control data to the one or more sound rendering systems, the amplifier means, filtering means, and delay means of each transducer being controllable by said control data provided by said system controller, wherein the system controller is arranged to configure and control a first sound zone and a second sound zone, said first and second sound zones being perceptible as two different sound areas by listeners; and wherein the system controller configures each of the one or more sound rendering systems to obtain a specific sound isolation between the first sound zone and the second sound zone.

8. A system according to claim 7, where the sound isolation between the first and second sound zones is characterized as a level of interference from an interferer audio programme provided from the second sound zone to an active listener in the first sound zone.

9. A system according to claim 8, wherein a mode of operation of the listener in the first sound zone is selected from listening to a target audio programme for purposes of information gathering, listening to a target audio programme for purposes of entertainment, and listening to a target audio programme of silence for purposes of reading or working, wherein the target audio programme for purposes of information gathering is one or more of male news speech, female news speech, and sports commentary, wherein the target audio programme for purposes of entertainment is one or more of vocal pop music, sports commentary, and instrumental classical music, and wherein each mode of operation of the listener in the first sound zone has respective values of sound isolation for obtaining a specific threshold of acceptability for the interferer audio programme provided from the second sound zone.

10. A system according to claim 8, wherein the interferer audio programme provided from the second sound zone is an active sound source provided from the one or more sound rendering systems, and wherein the interferer audio programme is active in at least one mode selected from male speech, instrumental classical music, and vocal pop music; and wherein each mode for the interferer audio program has respective values of sound isolation for obtaining a specific threshold of acceptability for the interferer audio programme as perceived in the first sound zone.

11. A system according to claim 9, wherein the respective values of sound isolation for the modes of operation of the listener in the first sound zone related to experienced users are:

information gathering in high-threshold conditions: -2 dB to -12 dB;

information gathering in low-threshold conditions: -25 dB to -42 dB;

entertainment: -27 dB to -39 dB;

reading or working: -31 dB to -58 dB.

12. A system according to claim 9, wherein the respective values of sound isolation for the modes of operation of the listener in the first sound zone related to inexperienced users are:

information gathering in low-threshold conditions: -13 dB to -24 dB;

entertainment: -17 dB to -31 dB;

reading or working: -12 dB to -35 dB.

13. A system according to claim 12, wherein the system controller monitors and adjusts the value of sound isolation in the second sound zone to be within a specified value for the threshold of acceptability.

* * * * *